United States Patent [19]

Hard et al.

[11] Patent Number: 4,655,825

[45] Date of Patent: Apr. 7, 1987

[54] METAL POWDER AND SPONGE AND PROCESSES FOR THE PRODUCTION THEREOF

[75] Inventors: Robert A. Hard, Oley, Pa.; Joseph A. Megy, Corvallis, Oreg.

[73] Assignee: Occidental Research Corporation, Los Angeles, Calif.

[21] Appl. No.: 648,736

[22] Filed: Sep. 10, 1984

Related U.S. Application Data

[63] Continuation-in-part of Ser. No. 439,801, Nov. 8, 1982, Pat. No. 4,470,847, and a continuation-in-part of Ser. No. 626,672, Jul. 2, 1984.

[51] Int. Cl.[4] ..... B22F 9/00

[52] U.S. Cl. ..... 75/0.5 B; 75/0.5 BA; 75/0.5 BB; 75/251

[58] Field of Search ..... 75/0.5 BB, 84.4, 84.5, 75/251, 0.5 B, 0.5 BA

[56] References Cited

U.S. PATENT DOCUMENTS

| | | | |
|---|---|---|---|
| 3,119,685 | 1/1964 | Hansley et al. | 75/0.5 BB |
| 4,356,029 | 10/1982 | Down et al. | 75/0.5 BB |
| 4,390,365 | 6/1983 | Hard et al. | 75/84.4 |
| 4,445,931 | 5/1984 | Worthington | 75/84.4 |
| 4,470,847 | 9/1984 | Hard et al. | 75/84.4 |
| 4,477,277 | 10/1984 | D'Altilia | 75/84.4 |

*Primary Examiner*—Wayland Stallard

*Attorney, Agent, or Firm*—Christie, Parker & Hale

[57] ABSTRACT

Passified Zinc Soluble Metal-Based Metal particles having a controlled particle size distribution suitable for metallurgy usage without additional particle size reduction and process for making the same. Such metal particles are substantially free of halides, hydrogen, oxygen, nitrogen and carbon and are produced at temperatures considerably below that of arc melting temperatures of Zinc Soluble Metal-Based Metals and alloys based thereon.

52 Claims, 6 Drawing Figures

METAL POWDER AND SPONGE AND PROCESSES FOR THE PRODUCTION THEREOF

This patent application is a continuation-in-part application of U.S. patent application Ser. No. 439,801, now U.S. Pat. No. 4,470,847 filed Nov. 8, 1982 on PROCESS FOR MAKING TITANIUM, ZIRCONIUM AND HAFNIUM-BASED METAL PARTICLES FOR POWDER METALLURGY and U.S. patent application Ser. No. 626,672 filed July 2, 1984 on GROUP IVB TRANSITION METAL BASED METAL POWDER AND PROCESSES FOR THE PRODUCTION THEREOF which is incorporated by reference.

CROSS REFERENCE TO RELATED PATENT APPLICATIONS

This patent application is related to U S. Ser. 216,058 filed Dec. 22, 1980, now U.S. Pat. No. 4,390,365, and titled "Process for Making Titanium Metal from Titanium Ore."

BACKGROUND OF THE INVENTION

Titanium, manganese, iron, cobalt, nickel, copper, germanium, yttrium, zirconium, rhodium, palladium, silver, antimony, hafnium, platinum, gold, praseodymium, thorium and uranium are essential to industry either as pure metals or alloys. These metals are used in the aerospace, nuclear, electronic, machine tool, chemical and heavy industries for a myraid of applications. Many of these metals are difficult to process into pure metals having less than 10,000 parts per million by weight ["PPM" herein) contaminates, such as alkali metals, halides, hydrogen, nitrogen, oxygen and carbon. In addition, it is difficult to combine these metals to form mixtures or alloys, such as a nickel-titanium alloy, of these metals having less than 10,000 PPM contaminates.

Impurities outside specification values in these metals, such as metals and alloys based on the Group IVB metals, can cause such metals and alloys based thereon to be brittle and hence, of little use. Impurities such as halides, carbon, oxygen, nitrogen, and silicon can cause the Group IVb metals and alloys based thereon to be greatly reduced in strength and chemical resistance. Small amounts of silicon and oxygen can be used in Group IVb transition metal alloys, such as hafnium and zirconium alloys.

These metals and alloys thereof are also useful in powder metallurgy for the production of articles which would be more expensive or more difficult to produce by machining or forging from massive metal shapes. This invention is directed toward the production of metal powders and sponge of the above metals and alloys thereof. Articles made by powder metallurgy from such powders can be ground, milled, forged, rolled, drilled, and welded.

SUMMARY OF THE INVENTION

This invention relates to the passified Zinc Soluble Metal-Based Metal particles which are substantially free of halides, and which are suitable for powder metallurgy usage without further particle size reduction, and processes for the production thereof. By particles as used herein, is meant to include powders and granules as well as particles.

Zinc Soluble Metal-Based Metal is a metal or a mixture or alloy of two or more of such metals that has a solubility of at least about 3% by weight in molten zinc at 900° C., a vapor pressure of less than about 100 Torr at 1,000° C., and a melting point above 900° C. Although antimony has a melting point of less than 900° C., alloys or mixtures of antimony and Zinc Soluble Metal-Based metals are considered Zinc Soluble Metal-Based Metals when the alloys or mixtures meet the above solubility, vapor pressure and melting point specifications. The Zinc Soluble Metal-Based Metals of the present invention are Ti, Mn, Fe, Co, Ni, Cu, Ge, Y, Zr, Rh, Pd, Ag, Sb, Hf, Pt, Au, Pr, Th, U, and mixtures thereof, including alloys thereof. The mixtures and alloys consist essentially of one or more Zinc Soluble Metal-Based Metals and minor amounts, less than 5% by weight, if any, of other elements; provided, however that such mixtures and alloys can contain up to 50% or more by weight of the other elements if the resulting mixtures and alloys meet the above solubility, vapor pressure, and melting point specifications.

A very important advantage of this invention is the capability of producing metal shapes, i.e., near net shapes, directly from metal sponge particles without the necessity of any expensive arc melting step which is required in conventional technology for consolidation or alloying of the Group IVb transition metals.

In one embodiment of this invention, which comprises hydriding, such passified Zinc Soluble Metal-Based Metal particles are produced by heating a Zinc Soluble Metal-Based Metal-zinc alloy which is substantially free of halides, at a temperature between about 500° and about 1150° C. under conditions which are operative to vaporize and separate the zinc from such alloy and to produce a Zinc Soluble Metal-Based Metal sponge thereon which is substantially free of both zinc and halides. Conventional metal sponges have an internal porosity of between about 15% to about 25% by volume. The metal sponges of the present invention have internal porosities of between about 5% to about 40% by volume. By substantially free of zinc herein is meant less than 0.1% by weight zinc. By substantially free of halides herein is meant less than 0.02% by weight halides. In some embodiments of this invention, no more than about 100 parts per million by weight (PPM) of zinc and about 50 PPM of halides are contained in the Zinc Soluble Metal-Based Metal. Preferably the Zinc Soluble Metal-Based Metal thereof has less than about 10 PPM metal halide.

In an alternative embodiment of the present invention which does not require hydriding and dehydriding, the Zinc Soluble Metal Based Metal-zinc alloy can be comminuted to or formed into particles and the zinc distilled off as described herein to produce Zinc Soluble Metal-Based Metal powder. Some Zinc Soluble Metal-Based Metal-zinc alloys are brittle and comminute easily and other Metal-zinc alloys are tough which renders the alloy more difficult to comminute. The Zinc Soluble Metal-Based Metal-zinc alloy can be formed into small particles by conventional means known to the art, such as shot tower processing in a nondeletiously reactive atmosphere, such as a helium or argon atmosphere.

Zinc Soluble Metal-Based Metals prepared by conventional processes, such as the Hunter process or Kroll process for titanium may contain halide salts, such as sodium chloride or magnesium chloride. With conventional processes, it is difficult to produce Group IVb transition metals having halide contents of less than 2000 PPM. Halides can form fine small holes in the Zinc Soluble Metal-Based Metals which act as crack initiators and make the metal liable to fatigue cracking. In addition, it can be difficult to obtain good welds on Zinc Soluble Metal-Based Metals having a halide content of more than 50 PPM. As a consequence of the halide contamination metals used in high technology applications, such as aircraft, submarine or nuclear applications, must be subject to processes such as ingot metallurgy, to reduce the halide content. A metal is conventionally melted twice using arc metallurgy. Arc metallurgy processes are capital intensive and energy intensive.

By Zinc Soluble Metal-Based Metal-zinc alloy herein is meant an alloy of zinc and zinc Soluble Metal-Based Metal. The zinc may be sublimed from the metal-zinc alloy by heating the alloy to a temperature of from about 500° C. to about 1150° C. to produce Zinc Soluble Metal-Based Metal sponge. The sponge may be sintered by heating the sponge to a temperature below the melting point of the Zinc Soluble Metal-Based Metal, but at least at a temperature greater than 60% of the melting point temperature of the Zinc Soluble Metal-Based Metal ("sintering temperature range" herein) under conditions which are operative to sinter the metal sponge. Sintering is necessary in order to reduce the surface area of the Zinc Soluble Metal-Based Metal sponge and thus reduce the amount of oxygen or nitrogen required for subsequent passification of the Metal sponge so that it may be readily and safely stored and used for powder metallurgy at a later time..

During sintering, the particles of Zinc Soluble Metal-Based Metal shrink in size by about 50 to about 85% in volume but in general retain their original shape Such sintered particles are not fused together although usually there is some sticking or adhering of the particles to each other. Such adhered particles can be readily separated by mechanical means.

The particles of sintered Zinc Soluble Metal-Based Metal are cooled to a lower temperature between about 300° and 700° C. during which time they are simultaneously contacted with hydrogen or a gaseous stream containing hydrogen under conditions which are operative to hydride and embrittle the sintered Metal. Not all Zinc Soluble Metal-Based Metals can be hydrided.

Most Zinc Soluble Metal-Based Metal-zinc alloys are brittle and can be ground to powder before removal of zinc by sublimation. However, the metals can be ground or comminuted after removal of zinc by sublimation. A few Zinc Soluble Metal-Based Metal-zinc alloys are not brittle and are more economically cast into particles or comminuted after removal of the zinc by embrittling the resulting metal sponge by hydriding with hydrogen.

The hydrided and embrittled Zinc Soluble Metal-Based Metal can be readily comminuted to a predetermined particle size distribution. The hydriding and subsequent embrittlement greatly facilitates controlling the comminution of the Zinc Soluble Metal-Based Metals. The improved controllability afforded by the hydriding of the Zinc Soluble Metal-Based Metals can be a particularly important aspect of this invention because it ultimately enables the production of a passified Zinc Soluble Metal-Based Metal particles of a size distribution readily adaptable and operable for powder metallurgy usage.

Such hydrided and embrittled Zinc Soluble Metal-Based Metal particles are comminuted under a non-deleteriously-reactive atmosphere, to a predetermined particle size distribution. The comminuted Metal values are treated at a temperature between about 400° and about 700° C., preferably between about 600° and about 700° C. under conditions operative to remove essentially all hydrogen values from the comminuted Metal values and to produce Zinc Soluble Metal-Based Metal particles. By the expression "Metal values" is meant Zinc Soluble Metal-Based Metals. By the expression "removing essentially all hydrogen values from the comminuted transition Metal values" is meant that the Metal values maintain more than about 200 PPM of hydrogen.

The hydrided Zinc Soluble Metal-Based Metal particles are then contacted with a small or effective amount of a gas selected from the group consisting of oxygen, nitrogen and mixtures thereof, under conditions operative to passify the Metal particles thereby producing passified Zinc Soluble Metal-Based Metal particles. The passification step is preferably controlled to prevent excess contamination of the Metal values with nitrogen and oxygen which are introduced during passification. Some Metals, such as gold, do not require passification to prevent further oxidation. The controlled comminuting of the hydrided and embrittled Metal values is such that the passified Zinc Soluble Metal-Based Metal particles ultimately produced have at least a substantial amount by weight of Zinc Soluble Metal-Based Metal particles which are suitable for powder metallurgy usage without further particle size reduction. As used herein, a substantial amount is meant at least about 50% by weight of the particles produced. In one embodiment of this invention, at least about 95% by weight of the particles produced are suitable for powder metallurgy use without further particle size reduction. Generally, particles no greater than about 30 mesh, preferably no greater than 100 mesh (U.S. Sieve Series), are suitable for powder metallurgy usage without further particle size reduction. It is to be noted that this embodiment of this invention is particularly useful where fine powder metallurgical particles are required or where a yield of suitable powder is required, or where a highly tailored particle size distribution is required which is not easily or economically obtainable by other means. Very fine particles, 200 mesh, are not preferred because of their high surface area to volume ratio; such particles can absorb deleterious amounts of oxygen and/or nitrogen during passification.

In another embodiment of this invention, the heating of the Zinc Soluble Metal-Based Metal-zinc alloy to vaporize zinc therefrom, and the subsequent sintering of the transition Metal values produced therby is conducted in the same zone or vessel. In a further emodiment, the hydriding and embrittlement of the sintered Metal values are also conducted in the same zone or vessel as the zinc vaporization and sintering steps.

In another further embodiment of this invention, the non-deleteriously-reactive atmosphere used during the comminuting of the embrittled hydrided Metal values and/or sintering of the Metal values is an inert gas, such as argon or helium. In another embodiment, the non-deleteriously-reactive atmosphere used during the comminuting step is hydrogen.

In still another further embodiment of this invention the heating or distillation of the Zinc Soluble Metal-Based Metal-zinc alloy to vaporize and separate zinc, therefrom, is conducted under a partial vacuum. In a second embodiment of this invention, such heating is conducted under a continuous flow of a nondeleteriously-reactive sweep gas. In a further embodiment, the sweep gas is selected from the Group consisting of hydrogen, inert gas (such as, argon or helium), and mixtures thereof.

In one further embodiment of this invention, the dehydriding and/or sintering of the particles of Metal values is conducted under a partial vacuum.

Another embodiment of this invention, where Metal values cannot be hydrided, passified Zinc Soluble Metal-Based Metal particles which are substantially free of halides, and which are suitable for powder metallurgy usage, are prepared from a Metal-zinc alloy, comprises forming a Zinc Soluble Metal-Based Metal-zinc alloy which is substantially free of halides, into particles having a particle size, of less than 30 mesh by weight. Then, heating such particles in a zone maintained at a temperature between about 500° and 1150° C., optionally under a partial vacuum or under a continuous flow of a nondeleteriously-reactive sweep gas. The zone is maintained under conditions operative to vaporize and separate zinc from the Metal-zinc alloy particles and thereby produce particles of Zinc Soluble Metal-Based Metal which are substantially free of zinc and halides. Such Metal values will comprise essentially the pure Zinc Soluble Metal-Based Metal or mixtures or alloys optionally with other metals desirable in the ultimate final product, that is, alloys thereof. For example, such other elements which may be desirable in the final product and known to those skilled in the art, include but are not limited to boron, carbon, oxygen, aluminum, silicon, phosphorus, calcium, vanadium, chromium, arsenic, selenium, gallium, molybdenum, cadium, idium, tin, cesium, barium, thallium, lead, bismuth, zinc and the like. These other elements may be used in the processes described herein if the Zinc Soluble Metal-Based Metal alloy of such other element or elements meets the solubility, vapor pressure and melting point specifications for Zinc Soluble Metal-Based Metal described herein.

The thusly formed particles which are substantially free of zinc, unless zinc is intentionally left in the Metal, and halides are then heated to, or maintained at, a sintering temperature range under conditions operative to sinter such particles. In general, sintering results in a reduction of the surface area of such particles and because of the reduction in surface area, subsequent passification with a passifying gas will require a substantially less amount of such gas and thus reduce the oxygen and/or nitrogen content of the Zinc Soluble Metal-Based Metal.

The sintered particles are then cooled to a temperature between about ambient and about 200° C., and then contracted with a small or effective amount of a gas selected from the Group consisting of oxygen, nitrogen, and mixtures thereof, under conditions operative to passify the cooled, sintered particles, thereby producing passified Zinc Soluble Metal-Based Metal particles which are substantially free of halides. In all emodiments of this invention it is preferable that the passified Zinc Soluble Metal-Based Metal particles be substantially free of halides because halide contamination of the final product can cause voids, loss of strength, and fracture toughness, and welding problems.

An important feature of this embodiment of this invention is the forming of Zinc Soluble Metal-Based Metal-zinc alloy of a specified and particular particle size distribution such that the particles will have a particle size of less than 30 mesh, preferably between about 100 and about 200 mesh. The subsequent sintering of such particles at a sintering temperature range, in combination with the other steps of this process, is operative to cause the passified Zinc Soluble Metal-Based Metal particles ultimately produced to have a particle size distribution such that a significant amount by weight of such particles are suitable for powder metallurgy usage without additional particle size reduction. By significant amount by weight suitable for powder metallurgy usage without additional particle size reduction as used herein is meant at least about 5% by weight. This embodiment of this invention is, however, capable of producing particles wherein at least about 80% by weight are suitable for powder metallurgy usage without additional particle size reduction.

An advantage of the invention is that the shape or configuration of the feed Zinc Soluble Metal-Based Metal-zinc alloy particles prior to vaporization of the zinc therefrom, and the subsequent sintering of the particles produced from said vaporization of zinc from the Metal-zinc alloy is retained through these sequence of steps. The vaporization of zinc produces particles having about 15 to about 50% of the volume of the feed alloy particles. Thus, it is possible to predetermine the shape of the feed alloy particles and produce pseudomorph particles of the feed alloy particles.

In a further embodiment, the heating or distillation of the particles of Zinc Soluble Metal-Based Metal-zinc alloy at a temperature between about 500° and about 1150° C., and the subsequent sintering of the zinc free particles therefrom, are conducted in the same zone or vessel. In a still further embodiment, the cooling and passification of the sintered particles are also conducted in the same zone or vessel as the zinc vaporization and sintering steps.

In still another further embodiment of this invention, the heating or distillation of the Zinc Soluble Metal-Based Metal-zinc alloy to vaporize and separate zinc therefrom is conducted under a partial vacuum. In a still further embodiment of this invention, the nondeleteriously-reactive sweep gas used in the heating or distillation of the Metal-zinc alloy is an inert gas. In an alternate embodiment such nondeleteriously-reactive sweep gas is hydrogen. However, where hydrogen is used as the sweep gas, it is necessary to remove all hydrogen values from the final Zinc Soluble Metal-Based Metal particles that form hydrides since hydrogen may cause embirttlement of such particles. Hydrogen can be removed in a dehydriding step described herein.

In a further embodiment of this process, the Metal-zinc alloy particles have a particle size distribution of about 90% by weight between about 60 mesh and about 20 mesh before such particles are heated or distilled at a temperature between about 500 and about 1150° C. to vaporize the zinc therefrom.

In another embodiment of this invention, the forming of a Metal-zinc alloy into such particles is by comminuting of the alloy. In an alternate embodiment such particles are formed by casting the Metal-zinc alloy into particles; preferably, particles of $-\frac{1}{4}$ mesh or smaller.

The following additional embodiments of this invention are useful whether or not hydriding is employed to facilitate comminution of the transition metal values.

The Zinc Soluble Metal-Based Metal-zinc alloy may be prepared by adding Zinc Soluble Metal-Based Metal scrap or sponge into a molten batch of zinc agitated to form the Zinc Soluble Metal-Based Metal-zinc alloy substantially free of halide. If the Metal sponge or scrap contains halide, such as sodium halide, the halide salt separated from the Metal-zinc alloy when the Metal-zinc alloy is formed. The halide salt is immiscible with the Metal zinc alloy and floats to the surface of the molten alloy as a separate phase which can be separated from the alloy by conventional means to produce a Zinc Soluble Metal-Based Metal-zinc alloy substantially free of halide. Moreover, zinc metal and Zinc Soluble Metal-Based Metal may be melted together to form the Zinc Soluble Metal-Based Metal-zinc alloy substantially free of halide. When the powder metal end product is to be an alloy of one or more Zinc Soluble Metal-Based Metals and one or more other elements as alloying agent, the alloying agent may be incorporated into the molten zinc batch prior to introduction of the Zinc Soluble Metal-Based Metal, or added with the Zinc Soluble Metal-Based Metal to the molten-zinc batch, or co-melted with the zinc metal and the Zinc Soluble Metal-Based Metal, The Metal-zinc alloy can be prepared from Zinc Soluble Metal-Based Metal halide salts as set forth in the process described herein by adding the Metal halide salt with zinc and a reductant metal, such as, and preferably, aluminum, and melting and agitating the resulting mixture. Optionally, an alkali metal halide salt may be added to the mixture to form a floating phase immiscible with the Metal values to inhibit the vaporization of the molten zinc. In addition, alloying agents may be added to produce a Zinc Soluble Metal-Based Metal-zinc alloy containing the desired alloying agents to yield a Zinc Soluble Metal-Based Metal alloy product as described herein. The various components may be mixed together and melted as a mix or alternatively the various ingredients may be added to molten zinc or the molten batch of zinc and the reductant metal. Alternatively, the Zinc Soluble Metal-Based Metal halide salt may be contacted with the zinc and reductant metal to form the Metal-zinc alloy substantially free of halide. Alloy agents may then be added to the molten Metal-zinc alloy to incorporate the desired alloying agents. Such Metal-zinc alloy, with or without additional alloying agents, may be treated as described herein to produce passified Zinc Soluble Metal-Based Metal powders, suitable for metallurgy usage, substantially free of halide and zinc.

In one embodiment of this invention, wherein the Zinc Soluble Metal-Based Metals are titanium, zirconium or hafnium, the entire process is conducted at temperatures which are no higher than about 1300° C., and in a preferred embodiment, the entire process is conducted at temperatures which are no higher than about 1200° C., and in an especially preferred embodiment, at a temperature no higher than 1150° C. to prevent sintering of the Zinc Soluble Metal-Based Metal particles. Thus, the temperatures reached during the conventional high temperature arc melting processes, required for consolidation of, and/or alloying of, for example, titanium products produced by conventional processes, such as, the "Kroll Process", are not required. In other words, the high temperatures required for arc melting are simply not required for this process. Arc melting processes generally require temperatures which exceed the melting point of the particular Zinc Soluble Metal-Based Metal by about 50 to 100° C. Such high temperature processes, including those requiring arc melting, require costly equipment which is simply not required by this invention. Thus, a distinct advantage of this invention is the avoidance of very high temperatures required in processes which comprise arc melting. Some of the advantages of using hydrogen as the sweep gas in the heating or distillation step to vaporize zinc from the Metal-zinc alloy are (1) hydrogen, because of its low molecular weight, facilitates the diffusion of zinc out of the Metal sponge pores and by virtue of such improved diffusion improved heat transfer during the distillation is also realized, (2) hydrogen is cheaper than helium and argon and other inert gases, and (3) although the hydrogen tie bond between hydrogen and many Zinc Soluble Metal-Based Metals are weak hydrogen will more readily displace zinc than inert gases where there is no tie bond between the inert gas and the Zinc Soluble Metal-Based Metal at all. However, if hydrogen is used, substantially all hydrogen values must be removed from the final Metal particle product wherein the Metal values are capable of being hydrided. Hydrogen can be removed from such Metal particles by heating the particles to a temperature at from about 600° to about 700° C., preferably under a partial vacuum. By substantially all hydrogen values being removed from the final metal particle product it is meant that no more than about 200 PPM of hvdrogen is permitted in the final metal particles produced, and preferably no more than about 50 PPM of hydrogen is in the final product. This is to be compared with some conventional process which produce particles having 200 PPM or more of hydrogen. However, it should be noted that in some embodiments of this invention the process is capable of producing product particles having less than 50 PPM hydrogen.

It is also desirable and the process is capable of producing Zinc Soluble Metal-Based Metal particles which are substantially free of oxygen, nitrogen and carbon. The term "substantially free of oxygen, nitrogen and carbon" as used herein is meant no more than about 2500 PPM of oxygen, 400 PPM of nitrogen, and 800 PPM, of carbon. In some embodiments of this invention, no more than about 800 PPM of oxygen, 90 PPM of nitrogen, and/or 150 PPM of carbon are contained in the product particles of the Metal values.

The Metal sponge, comprising Zinc Soluble Metal-Based Metal, of the present invention is characterized in having less than 50 PPM of halides and an internal porosity of between 5% and 40% by volume. Preferably, the metal has less than about 10 PPM halide and an internal porosity of at least 20% by volume. The powdered metal, comprising Zinc Soluble Metal-Based Metal, of the present invention have, besides the same low halide content and high internal porosity as the metal sponge, angular shaped powder particles. Angular shaped powder particles are irregular shaped particles with irregular surface faces on walls and irregular edges. The metal sponge of the present invention is unequaled, and no Zinc Soluble Metal-Based Metal sponge having the low halide, hydrogen and carbon contamination and high internal porosity described herein has been prepared before. The powder metal of the present invention is unique and no Zinc Soluble Metal-Based Metal powder having the low halide, hydrogen, oxygen, nitrogen, and carbon contamination and high internal porosity set forth herein and angular shaped powder particles have been prepared before. In fact, it is believed that such metal sponge and powdered metal can only be produced by the process of this invention.

The Zinc Soluble Metal-Based Metal powder and sponge of the present invention are superior metals for metallurgical use. The low halide content enhances maximum metal strength, toughness and durability. The high internal porosity and angular particle shape of the powder permits the fabrication by conventional powder metallurgical processes of strong, durable and defect free shaped Zinc Soluble Metal-Based Metal pieces, such as shaped articles, plates, sheets, pipes, rods, beams, and billets. The compressibility of the powder and the angular particles of the powder permit the particles to be closely pressed together and securely interlocked when pressed into the desired shapes yielding a cold pressed article with greater green strength than conventional Zinc Soluble Metal-Based Metal powders for powder metallurgy usage which have higher amounts of contaminants, very little internal porosity and spherical shaped powder particles.

Another advantage of this invention is that the Metal-zinc alloy can contain additional alloying agents such as aluminum, vanadium or other beneficial elements, which may be desirable in the final product particles. Such alloying agents are not required to be added in a high temperature arc melting step. In fact, arc melting is not required in this invention. The alloying agents can be added to the Metal values when it is in the form of a Zinc Soluble Metal-Based Metal-zinc alloy or when such alloy is made. For example, the alloying agent can be added to molten zinc to form a molten zinc alloy. The Zinc Soluble Metal-Based Metal, such as titanium metal sponge, can be added to the molten zinc alloy to for a Zinc Soluble Metal-Based Metal-zinc alloy. Alternatively, a Zinc Soluble Metal-Based Metal halide salt, such as sodium fluotitanate, can be added to a molten bath of zinc, alloying agent and reductant metal, such as aluminum, is present to reduce the halide salt and produce the Zinc Soluble Metal-Based Metal-zinc alloy which is recovered by separating it from the floating slag containing the halide salt of the reductant metal, formed during the reduction of the Metal halide salt. Such alloying agents remain with the Metal values as the zinc is vaporized and separated therefrom. In one preferred embodiment of this invention, the heating or distillation of zinc from the metall-zinc alloy is conducted at a temperature between about 900° and about 950° C. sintering is conducted between about 1020° and about 1060°, embrittlement and hydriding is conducted between about 600° and about 700° C., and passification is conducted at about ambient to about 60° C. It will be appreciated that a particular advantage of this process is the avoidance of entrapment of halide salts in the passified Zinc Soluble Metal-Based Metal particle product. Another advantage is that heating or distillation to vaporize and separate zinc and sintering may be conducted in the same zone, reactor, or vessel

DESCRIPTION OF THE PREFERRED EMBODIMENT

Figure 1:
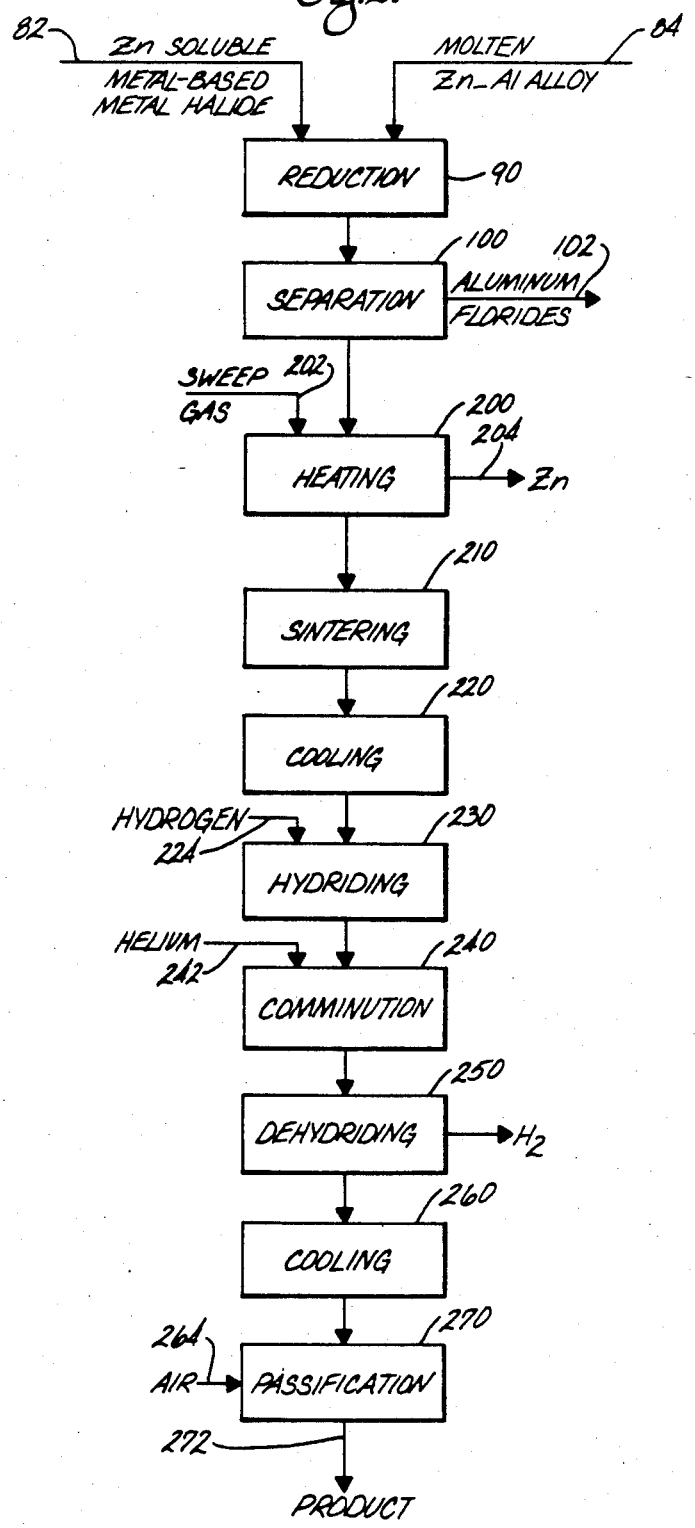
FIG. 1 is a flow sheet of one embodiment of this invention which comprises hydriding and dehydriding steps.

Referring to FIG. 1, the halide salt of a Zinc Soluble Metal-Based Metal sponge that can be hydrided, that is the Metal can be hydrided, such as sodium fluotitanate, is introduced via stream 82 and reduced in a molten state in zone 90 and a molten zinc-aluminum alloy introduced in stream 84. The molten metal halide salts and the zinc-aluminum alloy are essentially immiscible. Reduction is conducted at a temperature of at least about 650° C. up to about 1000° C. with agitation. After reduction is completed, agitation is ceased, and the mixture is separated in separation zone 100, into an upper phase comprising an aluminum halide salt which is removed in stream 102, and a lower phase comprising a Zinc Soluble Metal-Based Metal-zinc alloy which is removed in stream 110. The Metal-zinc alloy is substantially free of halides.

It is desirable to have as much Zinc Soluble Metal-Based Metal into the molten zinc alloy in zone 90 as possible to minimize the amount of zinc to be separated in the next step. The amount of Metal values in the zinc can be substantially increased by operating zone 90 under a positive pressure. The Metal-zinc alloy removed in stream 110, which is substantially free of halides, is heated or distilled in zone 200 at a temperature between about 900° and 1000° C. while simultaneously introducing into zone 200 a continuous flow of hydrogen sweep gas in stream 202 under conditions effective for vaporizing and separating zinc from the alloy and to produce Metal values which are substantially free of zinc and halides. The zinc is removed via stream 204. Such Metal values are then heated in the same vessel, depicted as zone 210, to a sintering temperature range under conditions operative to sinter such Metal values.

The sintered Metal values are cooled to a temperature between about 600° and about 700° C. in zone 220 and simultaneously treated, as depicted in zone 230, with hydrogen introduced in stream 224 under conditions operative to hydride and embrittle the sintered metal values. The hydrided and embrittled metal values are then crushed in zone 240 under an inert atmosphere, preferably helium introduced through stream 242, to form particles of metal values. The particles of Metal values are dehydrided in zone 250 at a temperature between about 600° and about 700° C. under conditions operative to remove essentially all hydrogen values from the particles of Metal values. The dehydrided particles are cooled in zone 260 to a temperature between ambient and about 60° C. and then passified in zone 270 with a relatively small amount of air introduced in stream 264. An effective amount of air is introduced under the passification conditions to passify the particles. Excess air is not required or desirable. At least a substantial part of the passified Zinc Soluble Metal-Based Metal particles thusly produced and removed in stream 272 are suitable for powder metallurgy usage without further particle size reduction.

Figure 2:
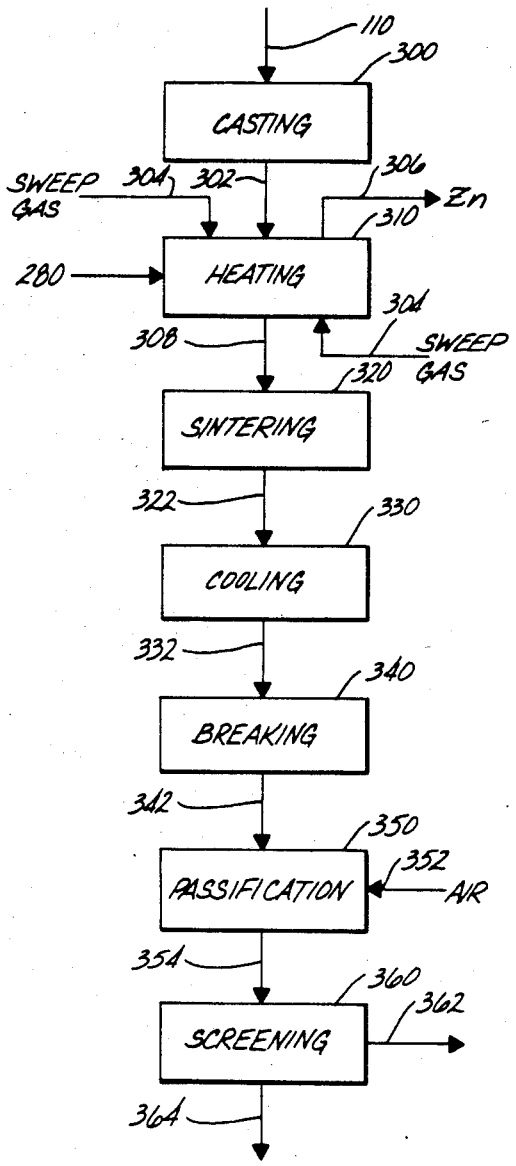
FIG. 2 is an alternate embodiment of this invention which does not require hydriding and dehydriding steps.

Referring to FIG. 2, in an alternate process, a molten stream of Zinc Soluble Metal-Based Metal-zinc alloy 110, which can be prealloyed with other desirable alloying agents such as aluminum and vanadium, is introduced into casting zone 300 wherein it is formed into particles having a particle size distribution between about 60 mesh and about 200 mesh. The 60 to 200 mesh particles are removed in stream 302 and introduced into heating or distillation zone 310 along with a continuous flow of helium sweep gas introduced through stream 304. In heating zone 310, which is operated at atmosphere pressure, the zinc is vaporized from the Metal-zinc matrix and removed through stream 306. Particles of Metal values, which are substantially free of zinc and halides, are removed by stream 308 and introduced into sintering zone 320 which is maintained at a sintering temperature range to sinter the particles of Metal values. During sintering the particles of Metal values shrink but do not fuse though some weak or adhering of particle-to-particle usually occurs. The sintered particle masses are removed through stream 322 and introduced into cooling zone 330 wherein they are cooled to a temperature between about ambient and about 60° C. The cooled particles are removed through stream 332 and introduced into breaking zone 340 wherein the weakly adhered particle masses are broken apart by suitable mechanical means under nondeleteriously-reactive environment. The thusly separated particles removed in stream 342 are introduced into passification zone 350 where they are passified with a relatively small amount of air introduced through stream 352. In some embodiments such breaking is not required. Passified Zinc Soluble Metal-Based Metal particles are removed through stream 354 and introduced into screening zone 360 wherein oversized particles are separated and removed through stream 362 and particles having desirable particle size are removed through stream 364. A substantial amount by weight of passified particles of Metal values having a desired particle size suitable for powder metallurgy usage without additional particle size reduction are removed through stream 364.

Figure 3:
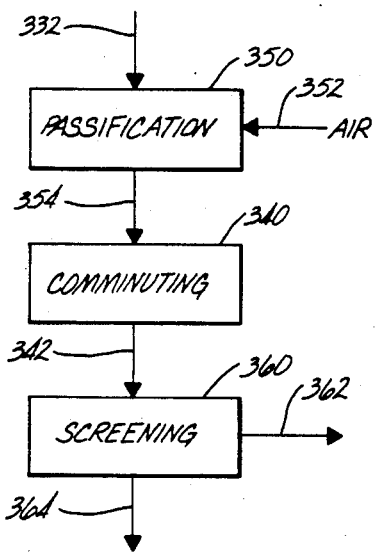
FIG. 3 is an alternative embodiment of this invention wherein the particles are passified before comminution.

An alternative embodiment of the process of FIG. 2 is shown in FIG. 3. The sintered particle masses are passed from cooling zone 330 (shown in FIG. 2) through stream 332 to passification zone 350 where they are passified with air introduced through stream 352 as described above. The passified sintered particle masses are passed from zone 350 into breaking zone 340 through stream 354 wherein the weakly adhered particle masses are broken apart by conventional mechanical means under a nondeleteriously-reactive environment as described above. The separated particles are passed from zone 340 into screening zone 360 through stream 342 wherein oversized particles are separated and removed through stream 362 and particles having the desired particle size are removed through stream 364.

Figure 4:
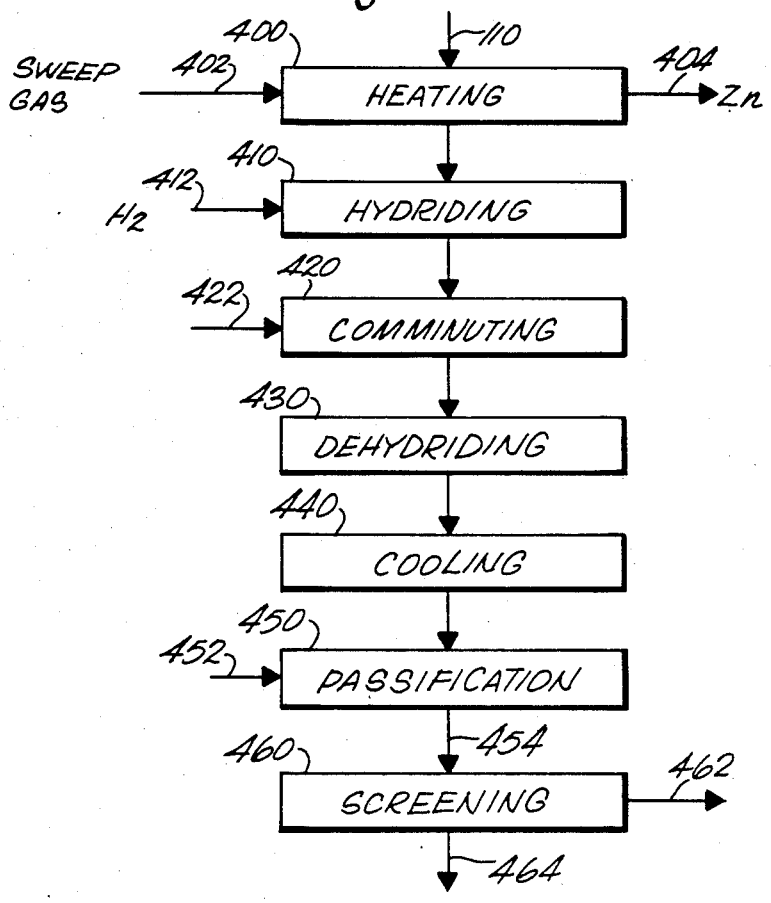
FIG. 4 is an alternative embodiment of this invention which does not require a sintering step.

Referring to FIG. 4, a process applicable to Zinc Soluble Metal-Based Metals capable of being hydrided, such as titanium, zirconium, hafnium, thorium and molybdenum is shown. A Zinc-Soluble Metal-Based Metal-zinc alloy, optionally alloyed with other alloying agents, which is substantially free of halides, is passed to heating zone 400 through stream 110 wherein the alloy is heated to distill off the zinc at a temperature between about 900°–1000° C. while simultaneously introducing into zone 400 a flow of hydrogen sweep gas from stream 402 under conditions effective for the distillation of the zinc from the alloy to produce Metal values which are substantially free of zinc and halide. The zinc is removed in stream 404. The Metal values are passed to hydriding zone 410 wherein the Metal values are treated with hydrogen introduced through stream 412 under conditions operative to hydride and embrittle the Metal values. The hydrided Metal values are comminuted in comminuting zone 420 under an inert atmosphere, such as argon or helium, introduced in stream 422 to form particles of Metal values. The hydrided Metal values may be comminuted with conventional equipment known to the art for crushing metal values. Such equipment may be modified for comminuting under an inert atmosphere. The particles of Metal values from zone 420 are passed to dehydriding zone 430 wherein the particles are heated to a temperature between about 600°–700° C. under conditions operative to remove essentially all the hydrogen values from the particles. The dehydrided particles are cooled in cooling zone 440 to a temperature between about ambient to about 60° C. and then passed to a passification zone 450 and passified with a small or effective amount of air introduced in stream 452. The passified particles of Zinc Soluble Metal-Based Metal are passed to screening zone 460 wherein oversized particles are separated and removed through stream 462 and particles having the desired particle size distribution are removed through stream 464.

Figure 5:
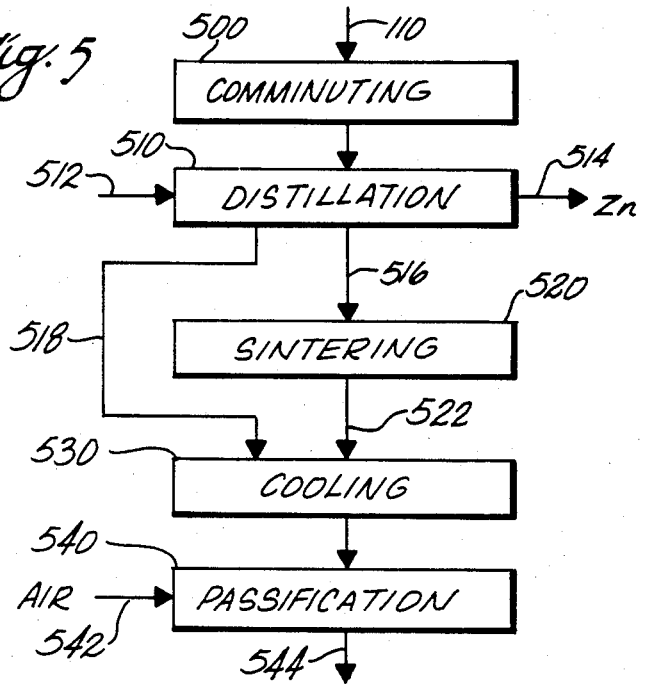
FIG. 5 is a further alternate embodiment of this invention which does not require the hydriding and dehydriding steps, and, optionally, does not require the sintering step.

Referring to FIG. 5, and an alternative process, a Zinc Soluble Metal-Based Metal-zinc alloy, which may be optionally alloyed with other alloying agents, is introduced into comminuting zone 500 through 110 wherein the alloy is crushed or ground to predetermined particle size, preferably from about 80 mesh to about 100 mesh, to form particles of the Metal-zinc alloy. Alternatively, the Metal-zinc alloy can be cast into irregular particles of a predetermined particle size in a casting zone (not shown) rather than comminuted as described herein. The Metal-zinc alloy can also be formed into particles by conventional shot forming techniques (not shown), such as the shot tower techniques. The particles are preferably deformed into irregular particles by dropping the particles on a hard cooled surface. .The particles are passed to a distillation zone 510, optionally a non-deleteriously-reactive reactive sweep gas may be introduced through stream 512, wherein the zinc is vaporized from the particles of Metal-zinc alloy and the zinc is removed in stream 514. The resulting particles of Metal values, which are substantially free of zinc and halides, are introduced in a stream 516 into sintering zone 520 wherein the Metal values are then heated to a sintering temperature under conditions operative to sinter such Metal values. The sintered Metal values are introduced in stream 522 into cooling zone 530 wherein the sintered Metal values are cooled to a temperature between about ambient and about 60° C. The cooled sintered Metal values are introduced into passification zone 540 wherein Metal values are passified with an effective amount or relatively small amount of air introduced in stream 542 to produce passified Zinc Soluble Metal-Based Metal particles suitable for powder metallurgy usage which are removed in stream 544. In an alternative embodiment, the sintering step in zone 520 is eliminated and Metal values from distillation zone 510 are introduced into cooling zone 530 through stream 518 wherein the Metal values, substantially free of halides and zinc, are cooled to a temperature between about ambient and about 60° C. The cooled Metal values are introduced into passification zone 540 wherein the Metal values are passified with an effective amount of air introduced in stream 542 to produce passified Zinc Soluble Metal-Based Metal particles, substantial portions of which are suitable for powder metallurgy usage without further particle size reduction. Such passified Metal particles may be screened in a screening zone (not shown) to separate oversized particles from the particles of the desired particle size range. This alternative embodiment may be produced on a Metal sponge or powder which has a sufficiently reduced surface area that does not require the sintering step to further reduce the surface area.

Figure 6:
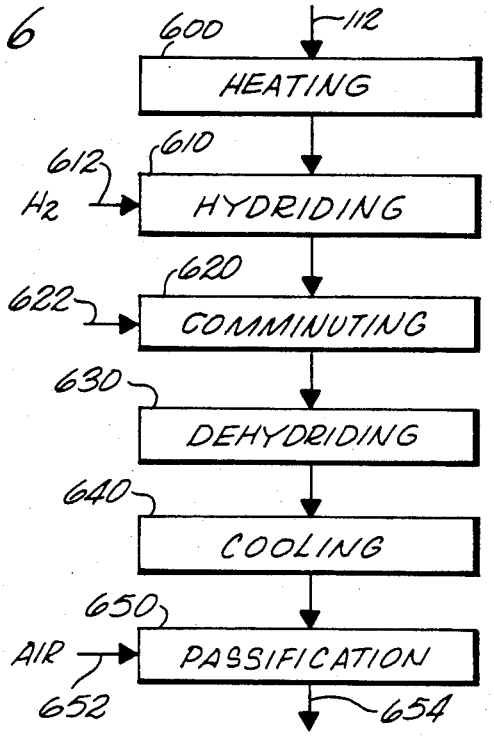
FIG. 6 is a flow sheet of one embodiment of this invention which comprises preparing a passified Zinc Soluble Metal-Based Metal powder from a passified Zinc Soluble Metal-Based Metal sponge.

Referring to FIG. 6, an alternative process is illustrated which employs sintered Zinc Soluble Metal-Based Metal sponge substantially free of halides and zinc which is produced from a Zinc Soluble Metal-Based Metal-zinc alloy substantially free of halide by distilling off the zinc to produce Metal sponge substantially free of halides and zinc, sintering the Metal sponge at a sintering temperature range under conditions operative to sinter such Metal values, and passifying the sintered Metal sponge with an effective amount or small amount of oxygen, nitrogen or air at a temperature between about ambient and about 60° C. to produce a passified Zinc Soluble Metal-Based Metal sponge which is introduced through stream 112 into heating zone 600 to heat the sintered Metal sponge to a temperature between about 600°-700° C. The heated passified Metal sponge is introduced in hydriding zone 610 wherein the Metal sponge, which is a Zinc Soluble Metal-Based etal sponge capable of being hydrided, is contacted with hydrogen gas introduced in stream 612 under conditions operative to hydride the heated Metal sponge at a temperature between about 600° and about 700° C. Optionally, the heating step and hydriding step in zones 600 and 610, respectively, can be carried out in the same vessel. The hydriding Metal sponge is passed to comminuting zone 620 wherein the Metal sponge is crushed to a desired particle size distribution using conventional Metal crushing equipment known to the art. Preferably, the comminuting performed under an inert atmosphere or gas introduced in stream 622 into zone 620. The Metal particles are introduced into dehydriding zone 630 wherein the Metal particles are dehydrided at a temperature between about 600°-700° C. under conditions operative to remove essentially all of the hydrogen values from the Metal particles. The dehydrided Metal particles are cooled in cooling zone 640 and passified in passification zone 650 with an effective amount or small amount of air introduced in stream 652 as described above with respect to FIG. 1. The resulting passified Zinc Soluble Metal-Based Metal particles are recovered from stream 654. Substantial portions of the Metal particles in stream 654 are suitable for powder metallurgy usage without additional particle size reduction. These particles may be screened in a screening zone (not shown) to remove the oversized particles from the particles of the desired particle size range.

It is to be understood that the foregoing detailed description is given merely as an illustrative example and that various modifications, changes, variations, and equivalent steps may be made to the invention herein described without departing from the spirit and scope of the present invention. For example, steps conducted at atmospheric pressure may in some circumstances be beneficially conducted at slightly higher or lower pressure than atmospheric and hence, by atmospheric we mean to include such slight pressure variations. Other elements are to be construed similarly.

To be useful for powder metallurgical processes, a Zinc Soluble Metal-Based Metal powder must have a particle size of less than 30 mesh and preferably about 100 mesh. The powder must not, however, be too fine as many of the Zinc Soluble Metal-Based Metals rely on an oxide or nitrogen surface coating to prevent further oxidation of the Metal by air. If the oxygen content from the oxide coating is too high on a bulk basis with respect to the amount of Metal, then the component made by powder metallurgy technology from the powder may be hard, brittle, and lack ductility. Therefore, the Metal powder cannot be made by sintering together finer particles, such as −200 mesh particles, which have previously been passified with air because the oxygen level in the powder may be too high and result in a Metal powder, because of oxygen contamination or nitrogen contamination, unsuitable for metallurgical applications. For the same reason, the internal porosity of the Zinc Soluble Metal-Based Metal sponge and powder must result from relatively large pores in the sponge or powder rather than small pores which would increase the surface area to volume ratio of the sponge and powder which, in turn, may cause unacceptable contamination of the Zinc Soluble Metal-Based Metal during processing. The internal porosity of the Metal powder is advantageous because it permits the powder to be deformed during pressing thus yielding greater green strength and minimizing the formation of large voids in the green body. The Metal powders prepared by present processes have relatively large pores with rounded boundaries. To avoid Metal contamination, the surface area of the particles and sponge should not exceed one square meter per gram ($M^2/g$) of Metal, preferably it should not exceed about 0.1 $M^2/g$. The Zinc Soluble Metal-Based Metal powders (+100 to −80 mesh) have a total surface area (external surface area and surface area of pores) of about 0.1 $M^2/g$ of Metal. The surface area of the pores of the Metal powders can be varied by sintering temperature and constitutes about 90% of the total surface area of the powder. Because of the large pore size, some of the Metal powders, such as a platinum powder, may be used as catalysts. Similarly, some of the Metal powders, such as titanium powders, can be used as catalyst support.

EXAMPLE 1

A charge of 340.4 grams of small zinc slabs, 16.45 grams nickel rod pieces, and 13.3 grams titanium sponge was placed in a graphite crucible. The crucible was heated in an electric furnace to 880° C. for two hours. The furnace was contained in a dry box filled with high purity argon. The contents of the crucible which were fully molten were cast in water cooled copper molds inside the dry box. After cooling the castings were ground in a rod mill to powder which was screened to −24/+80 mesh. The alloy was brittle and had a grinding yield of 80% to the desired particle size range. The zinc alloy powder was placed in a 400 series stainless steel crucible and the zinc sublined at $10^{-5}$ torr in a furnace. The temperature profile on the furnace during sublimation was as follows:

(a) 150° C. for two hours under vacuum.

(b) Ramped to 1000° C. for eight and one half hours.

(c) Held at 1000° C. for four hours.

(d) Cooled to room temperature in four hours. The product was loosely sintered and could be easily broken into individual particles by mechanical means. The product was examined by x-ray and microprobe and found to be almost entirely a 45-55% by weight titanium-nickel alloy sponge powder with 20% internal porosity. The pores were large with rounded boundaries and the BET surface area was 0.09 $M^2/g$.

EXAMPLE 2

Other Zinc Soluble Metal-Based Metasl sponges, such as Metal sponges of the following compositions, in weight percent, may be prepared in accordance with the process described in Example 1 using zinc, Zinc Soluble Metal-Based Metal and, optionally, other alloying agents as described herein:

| | | | | |
|---|---|---|---|---|
| (1) | 50% Ti | 50% Ni | | |
| (2) | 80% Fe | 20% Mn | | |
| (3) | 65% Fe | 25% Co | 10% Ni | |
| (4) | 90% Ti | 10% Zr | | |
| (5) | 60% Cu | 10% Ag | | |
| (6) | 50% Pd | 40% Ag | | |
| (7) | 66.67% Ag | 33.33% Pt | | |
| (8) | 78% Au | 22% Pd | | |
| (9) | 90% Pt | 10% Rh | | |
| (10) | 72% Ag | 28% Cu | | |
| (11) | 99% Zr | 0.25% Sn | 0.25% Fe | 0.05% Ni |
| (12) | 68.5% Fe | 18% Cr | 11% Ni | 2.5% Mo |
| (13) | 87% Ni | 10% Si | 3% Cu | |
| (14) | 55% Cu | 45% Ni | | |
| (15) | 90% Cu | 10% Sn | 0.25% P | |
| (16) | 92% Cu | 8% Al | | |
| (17) | 92% Ti | 5% Al | 2.5% Sn | 0.5 Fe |
| (18) | 90% Ti | 6% Al | 4% V | 0.25 Fe |

EXAMPLE 3

Zinc (500 g) and aluminum (7.25 g) are added to a tungsten crucible and comelted in an electric furnace at a temperature of between 660° and 700° C. Ferric chloride (53 g) and sodium chloride (58 g) are added to the zinc-aluminum melt and the resulting mixture agitated for 1 hour. The insoluble phase of sodium chloride and sodium chloraluminate is decanted from the molten zinc alloy. The molten zinc alloy is heated in a furnace to 1000° C. over a 12 hour period under a partial vacuum (about 5 Torr) to vaporize the zinc and produce iron sponge substantially free of zinc and halide. The iron sponge can be reduced to powder for powder metallurgical applications as described herein.

EXAMPLE 4

The chloride salts of Ti, Mn, Co, Ni, Cu, Ge, Y, Zr, Mo, Rh, Pd, Ag, Sb, Hf, Pt, Au, Pr, Th, U and mixtures thereof can be processed into the corresponding metal sponges in accordance with the process of Example 3. Such metal sponges can be processed into powders for powder metallurgical applications in accordance with processes described herein. Mixtures of chloride salts, such as gold chloride and silver chloride, may produce a Metal alloy or mixture depending upon the solubility of each Metal in the other Metals present.

Metal mixtures in contrast to Metal alloys, will consist of a substantially uniform matrix of microcrystals of each of such Metals in the mixture.

What is claimed is:

1. A powder metal consisting essentially of a Zinc Soluble Metal-Based Metal particles of less than 30 mesh having less than about 50 PPM by weight halide, an internal porosity of from about 5% to about 40% by volume, and the powder comprising angular shaped particles.

2. The powder metal of claim 1 wherein the Zinc Soluble Base Metal is selected from the group consisting of Ti, Mn, Fe, Co, Ni, Cu, Ge, Y, Zr, Rh, Pd, Ag, Sb, Hf, Pt, Au, Pr, U and mixtures thereof.

3. The powdered metal of claim 2 wherein the Zinc Soluble Metal-Based Metal has less than 5000 PPM of H, N, O, C and S.

4. The powdered metal of claim 2 wherein the powder metal has an average particle size of about 100 mesh.

5. Zinc Soluble Metal-Based Metal particles which are substantially free of halides, zinc, hydrogen, oxygen, nitrogen and carbon, and which are suitable for powder metallurgy usage, prepared from Zinc Soluble Metal-Based Metal-zinc alloy by:

(a) heating a Zinc Soluble Metal-Based Metal-zinc alloy, which is substantially free of halides, at a temperature between about 500° and about 1150° C. under conditions operative to vaporize and separate zinc therefrom and to produce Zinc Soluble Metal-Based Metal values which are substantially free of zinc and halide;

(b) sintering said Metal values at a sintering temperature between about 850° and about 1250° C. under conditions operative to sinter said Metal values;

(c) cooling said sintered Metal values to a temperature between about 300° and about 700° C. and simultaneously contacting said sintered Metal values with hydrogen under conditions operative to hydride and embrittle said sintered Metal values, thereby forming embrittled Metal values;

(d) comminuting said embrittled Metal values under a nondeleteriously-reactive atmosphere, to a predetermined particle size distribution, such that at least a substantial amount by weight of said particles are suitable for powder metallurgy usage without further particle size reduction, thereby forming particles of said Metal values;

(e) dehydriding said particles of said Metal values at a temperature between about 400° and about 700° C. under conditions operative to remove essentially all hydrogen values from said particles to produce dehydrided particles of said Metal values; and (f) contacting said dehydrided particles with a small amount of a gas selected from the group consisting of oxygen, nitrogen, and mixtures thereof under conditions operative to passify said dehydrided particles thereby producing passified Zinc Soluble Metal-Based Metal particles which are substantially free of halides, zinc, hydrogen, oxygen, nitrogen and carbon.

6. The metal particles of claim 5 wherein said Zinc Soluble Metal-Based Metal consists essentially of Ti, Mn, Fe, Co, Ni, Cu, Ge, Y, Zr, Rh, Pd, Ag, Sb, Hf, Pt, Au, Pr, U and mixtures thereof.

7. The metal particles of claim 5 wherein said Zinc Soluble Metal-Based Metal-zinc alloy heated in step (a) is an alloy consisting essentially of zinc and a Zinc Soluble Metal-Based Metal.

8. Passified Zinc Soluble Metal-Based Metal particles which are substantially free of halides, zinc, hydrogen, oxygen, nitrogen and carbon, and which are suitable for powder metallurgy usage, prepared from Zinc Soluble Metal-Based Metal-zinc alloy by the following steps:

(a) forming particles of a Zinc Soluble Metal-Based Metal-zinc alloy, which is substantially free of halides, hydrogen, oxygen, nitrogen and carbon, into particles having a particle size of less than 30 mesh by particle forming means;

(b) heating said particles of Zinc Soluble Metal-Based Metal-zinc alloy in a zone maintained at a temperature between about 500° and about 1150° C., and simultaneously introducing into said zone a continuous flow of a nondeleteriously-reactive sweep gas, said zone being maintained under conditions operative to vaporize and separate zinc from said Metal-zinc alloy particles and to produce first particles of Zinc Soluble Metal-Based Metal values which are substantially free of zinc and halides and have an internal porosity of from about 5% to about 40% by volume;

(c) sintering said first particles at a sintering temperature between about 850° and 1250° C. under conditions operative to sinter said first particles;

(d) contacting said sintered first particles at a temperature between about ambient temperature and about 200° C. with a small amount of a gas selected from the group consisting of oxygen, nitrogen, and mixtures thereof under conditions operative to passify said cooled sintered first particles thereby producing Zinc Soluble Metal-Based Metal particles which are substantially free of halides, zinc, hydrogen, oxygen, nitrogen and carbon; and (e) said forming of said Metal-zinc alloy particles in step (a), and said heating of said first particles in step (c) being operative to cause said passified Zinc Soluble Metal-Based Metal particles produced in step (d) to have a particle size distribution such that a significant amount by weight of said passified Zinc Soluble Metal-Based Metal particles are suitable for powder metallurgy usage without additional particle size reduction.

9. The metal particles of claim 8 wherein said Zinc Soluble Metal-Based Metal sintered particles of step (d) consists essentially of Ti, Mn, Fe, Co, Ni, Cu, Ge, Y, Zr, Rh, Pd, Ag, Sb, Hf, Pt, Au, Pr, U and mixtures thereof.

10. The metal particles of claim 8 wherein said Zinc Soluble Metal-Based Metal-zinc alloy particles formed in step (a) have an average particle size of about 100 mesh.

11. The metal particles of claim 8 wherein said forming of particles in step (a) comprises comminuting said Zinc Soluble Metal-Based Metal-zinc alloy.

12. The metal particles of claim 8 wherein said forming of particles in step (a) comprises casting said alloy.

13. A process to produce passified Zinc Soluble Metal-Based Metal particles which are substantially free of halides, and which are suitable for powder metallurgy usage, from a Zinc Soluble Metal-Based Metal-zinc alloy comprising:

(a) heating a Zinc Soluble Metal-Based Metal-zinc alloy, which is substantially free of halides, in a distillation zone maintained at a temperature between about 500° and about 1150° C. under conditions operative to vaporize and separate zinc from said transition metal-zinc alloy and to produce Zinc Soluble Metal-Based Metal values which are substantially free of zinc and halides;

(b) contacting said Metal values at a temperature between about 300° and about 700° C., with hydrogen under conditions operative to hydride and embrittle said Metal values, thereby forming embrittled Metal values;

(c) comminuting said embrittled Metal values under a nondeleteriously-reactive atmosphere, to a predetermined particle size of less than 30 mesh thereby forming particles of Metal values;

(d) dehydriding said particles of Metal values at a temperature between about 400° and 700° C. under conditions operative to remove essentially all hydrogen values from said particles of Metal values and to produce dehydrided particles of Metal values; and (e) contacting said dehydrided particles with an effective amount of a gas selected from the group consisting of oxygen, nitrogen, and mixtures thereof under conditions operative to passify said dehydrided particles thereby producing passified Zinc Soluble Metal-Based Metal particles which are substantially free of halides, zinc, hydrogen, oxygen and carbon.

14. The process of claim 13 wherein said heating step (a) is conducted under a partial vacuum.

15. The process of claim 13 wherein said heating step (a) is conducted under a continuous flow of a nondeleteriously-reactive sweep gas.

16. The process of claim 13 wherein said non-deleteriously-reactive sweep gas is selected from the group consisting of hydrogen, an inert gas, and mixtures thereof.

17. The process of claim 13 wherein said dehydriding step (d) is conducted under a partial vacuum.

18. A process to produce passified Zinc Soluble Metal-Based Metal particles which are substantially free of halides, zinc, hydrogen, oxygen and carbon and which are suitable for powder metallurgy usage, from a Zinc Soluble Metal-Based Metal-zinc alloy comprising:

(a) forming a Zinc Soluble Metal-Based Metal-zinc alloy, which is substantially free of halides, into irregular shaped particles having particle size of less than 30 mesh;

(b) heating said Zinc Soluble Metal-Based Metal-zinc alloy particles in a zone maintained at a temperature between about 500° and about 1150° C., under conditions operative to vaporize and separate zinc from said Metal-zinc alloy particles and to produce particles of Zinc Soluble Metal-Based Metal values which are substantially free of zinc and halides;

(c) contacting said particles of Metal values at a temperature below about 200° C. with a small amount of a gas selected from the group consisting of oxygen, nitrogen, and mixtures thereof under conditions operative to passify said particles thereby producing passified Zinc Soluble Metal-Based Metal particles which are substantially free of halides; and (d) said forming of particles in step (a), said heating of said particles in step (b) being operative to cause said passified particles produced in step (c) to have a particle size distribution such that at least a substantial amount by weight of said Zinc Soluble Metal-Based Metal particles are suitable for powder metallurgy ussage without further particle size reduction.

19. The process of claim 18 wherein the particles of Zinc Soluble Metal-Based Metal produced in heating step (b) are sintered at a sintering temperature between about 850° and 1250° C. under conditions operative to sinter said particles in a sintering zone to produce sintered particles of Zinc Soluble Metal-Based Metal prior to passifying said particles in passification step (c).

20. The process of claim 18 wherein said heating step (b) is conducted under a partial vacuum.

21. The process of claim 18 wherein said heating step (b) is conducted under a continuous flow of a non-deleteriously-reactive sweep gas.

22. The process of claim 21 wherein said non-deleteriously-reactive sweep gas is selected from the group consisting of hydrogen, an inert gas, and mixtures thereof.

23. A process to produce passified Zinc Soluble Metal-Based Metal particles which are substantially free of halides, zinc, hydrogen, oxygen, nitrogen and carbon, and which are suitable for powder metallurgy usage, from a passified Zinc Soluble Metal-Based Metal, substantially free of zinc and halides, comprising:

(a) contacting passified Zinc Soluble Metal-Based Metal values with hydrogen at a temperature between 300° and 700° C. under conditions operative to hydride and embrittle Metal values, thereby forming embrittled Metal values; (b) comminuting said embrittled Metal values under a nondeleteriously-reactive atmosphere, to a predetermined particle size of less than 30 mesh, thereby forming particles of hydrided Zinc Soluble Metal-Based Metal values;

(c) dehydriding said particles at a temperature between about 400° and about 700° C. under conditions operative to remove essentially all hydrogen values from said particles to produce dehydrided particles of Zinc Soluble Metal-Based Metal values;

(d) contacting said dehydrided particles with a small amount of a gas selected from the group consisting of oxygen, nitrogen, and mixtures thereof under conditions operative to passify said dehydrided particles thereby producing passified Zinc Soluble Metal-Based Metal particles which are substantially free of halides, zinc, hydrogen, oxygen, nitrogen and carbon; and (e) said comminuting of said embrittled Metal values to predetermined particle size in step (b) being operative to cause said passified Zinc Soluble Metal-Based Metal particles produced in step (d) to have a particle size such that at least a substantial amount by weight of said passified Zinc Soluble Metal-Based Metal particles are suitable for powder metallurgy usage without further particle size reduction.

24. The process of claim 23 wherein said nondeleteriously-reactive atmosphere used in step (b) is an inert gas.

25. The process of claim 23 wherein said dehydriding step (c) is conducted under a nondeleteriously-reactive sweep gas.

26. The process of claim 23 wherein said dehydriding in step (c) is conducted under a partial vacuum.

27. A metal sponge consisting essentially of a Zinc Soluble Metal-Based Metal useful for metallurgical applications characterized as having less than about 50 PPM by weight halide, less than 5000 PPM hydrogen, oxygen, nitrogen and carbon, and an internal porosity of from about 5% to about 40% by volume.

28. The metal sponge of claim 27 wherein the Zinc Soluble Metal-Based Metal is selected from the group consisting of Mn, Fe, Co, Ni, Cu, Ge, Y, Rh, Pd, Ag, Sb, Pt, Au, Pr, U and mixtures thereof.

29. The metal sponge of claim 28 wherein the metal is an alloy of titanium and nickel.

30. The metal sponge of claim 27 wherein the metal has less than about 10 PPM by weight halide and an internal porosity of about 10% to about 20%.

31. The metal sponge of claim 27 wherein the metal has less than about 2500 PPM by weight oxygen, less than about 400 PPM by weight nitrogen and less than about 800 PPM by weight carbon.

32. The metal sponge of claim 27 wherein the metal has less than about 50 PPM by weight oxygen, less than about 90 PPM by weight nitrogen, and less than about 150 PPM by weight carbon.

33. The metal sponge of claim 27 wherein the metal has less than about 10 PPM by weight halide.

34. A process to produce passified Zinc Soluble Metal-Based Metal particles which are substantially free of halides, zinc, hydrogen, nitrogen, oxygen and carbon and which are suitable for powder metallurgy usage, from Zinc Soluble Metal-Based Metal-zinc alloy comprising:

(a) heating a Zinc Soluble Metal-Based Metal-zinc alloy, which is substantially free of halides, at a temperature between about 500° and about 1150° C. under conditions operative to vaporize and separate zinc therefrom and to produce Zinc Soluble Metal-Based Metal values which are substantially free of zinc and halides;

(b) sintering said Metal values at a sintering temperature between about 850° and about 1150° C. under conditions operative to sinter said Metal values;

(c) contacting said sintered transition metal values at a temperature between about 300° and about 700° C. with hydrogen under conditions operative to hydride and embrittle said sintered Metal values, thereby forming embrittled Metal values;

(d) comminuting said embrittled Metal values under a nondeleteriously-reactive atmosphere, to a predetermined particle size thereby forming particles of embrittled metal values;

(e) dehydriding said particles of embrittled metal values at a temperature between about 400° and about 700° C. under conditions operative to remove essentially all hydrogen values from said particles of Metal values and to produce dehydrided particles of Metal values;

(f) contacting said dehydrided particles with an effective amount of a gas selected from the group consisting of oxygen, nitrogen, and mixtures thereof under conditions operative to passify said dehydrided particles thereby producing passified Zinc Soluble Metal-Based Metal particles which are substantially free of halides, zinc, hydrogen, nitrogen, oxygen and carbon; and (g) said comminuting of said embrittled Metal values to predetermined particle size distribution in step (d) being operative to cause said passified Zinc Soluble Metal-Based Metal particles produced in step (f) to have a particle size such that at least a substantial amount by weight of said passified particles are suitable for powder metallurgy usage without further particle size reduction.

35. The process of claim 34 wherein said Zinc Soluble Metal-Based Metal-zinc alloy is produced from Zinc Soluble Metal-Based Metal sponge and zinc.

36. The process of claim 34 wherein said Zinc Soluble Metal-Based Metal-zinc alloy is produced from the reduction of a Zinc Soluble Metal-Based Metal halide with a metal alloy which comprises a reductant metal and zinc.

37. The process of claim 34 wherein said Zinc Soluble Metal-Based Metal-zinc alloy is an alloy of zinc and a Zinc Soluble Metal-Based Metal selected from the group consisting of Ti, Mn, Fe, Co, Ni, Cu, Ge, Y, Zr, Rh, Pd, Ag, Sb, Hf, Pt, Au, Pr, U and mixtures thereof.

38. A process to produce passified Zinc Soluble Metal-Based Metal particles which are substantially free of halides, and which are suitable for powder metallurgy usage, from a Zinc Soluble Metal-Based Metal-zinc alloy comprising:

(a) forming a Zinc Soluble Metal-Based Metal-zinc alloy, which is substantially free of halides, into particles having a particle size of less than 30 mesh;

(b) heating said particles in a zone maintained at a temperature between about 500° and about 1150° C., and simultaneously introducing into said zone a continuous flow of a nondeleteriously-reactive sweep gas, said zone being maintained under conditions operative to vaporize and separate zinc from said Zinc Soluble Metal-Based Metal-zinc alloy particles and to produce first particles of Zinc Soluble Metal-Based Metal values which are substantially free of zinc and halides;

(c) sintering said first particles at a sintering temperature between about 850° and 1150° C. under conditions operative to sinter said first particles;

(d) contacting said sintered first particles with a small amount of a gas selected from the group consisting of oxygen, nitrogen and mixtures thereof at a temperature between ambient temperature and about 200° C. under conditions operative to passify said cooled sintered first particles, thereby producing passified Zinc Soluble Metal-Based Metal particles which are substantially free of halides, zinc, hydrogen, nitrogen, oxygen and carbon; and (e) said forming of particles in step (a), and said heating of said first particles in step (c) being operative to cause said passified particles produced in step (d) to have a particle size distribution such that a significant amount by weight of said passified Zinc Soluble Metal-Based Metal particles are suitable for powder metallurgy usage without additional particle size reduction.

39. The process of claim 38 wherein Zinc Soluble Metal-Based Metal-zinc alloy is produced from Zinc Soluble Metal-Based Metal sponge and zinc.

40. The process of claim 38 wherein said Zinc Soluble Metal-Based Metal-zinc alloy is produced from the reduction of a Zinc Soluble Metal-Based Metal halide with a metal alloy which comprises a reductant metal and zinc.

41. The process of claim 38 wherein said Zinc Soluble Metal-Based Metal-zinc alloy is an alloy of zinc and a Zinc Soluble Metal-Based Metal selected from the group consisting of Ti, Mn, Fe, Co, Ni, Cu, Ge, Y, Zr, Rh, Pd, Ag, Sb, Hf, Pt, Au, Pr, U and mixtures thereof.

42. The process of claim 38 wherein said nondeletoriously-reactive sweep gas used in step (b) is an inert gas.

43. The process of claim 38 wherein said heating in step (b) is conducted under a partial vacuum.

44. The process of claim 38 wherein said forming of particles in step (a) comprises comminuting of said Metal-zinc alloy.

45. The process of claim 38 wherein said forming of particles in step (a) comprises casting said Metal-zinc alloy.

46. A process to produce passified Zinc Soluble Metal Based Metal particles which are substantially free of halides, and which are suitable for powder metallurgy usage, from a Zinc Soluble Metal-Based Metal-zinc alloy comprising:

(a) forming a Zinc Soluble Metal-Based Metal-zinc alloy, which is substantially free of halides, into particles having a particle size of less than 30 mesh;

(b) heating said particles in a zone maintained at a temperature between about 500° and about 1150° C., and simultaneously introducing into said zone a continuous flow of a nondeleteriously-reactive sweep gas, said zone being maintained under conditions operative to vaporzie and separate zinc from said Metal-zinc alloy particles and to produce first particles of Zinc Soluble Metal-Based Metal values which are substantially free of zinc and halides;

(c) sintering said first particles of a sintering temperature between about 850° and 1150° C. under conditions operative to sinter said first particles;

(d) contacting said first particles with hydrogen at a temperature between about 300° and about 700° C. under conditions operative to hydride and embrittle said first particles, thereby forming embrittled Zinc Soluble Metal-Based Metal values;

(e) comminuting said embrittled Metal values under a nondeleteriously-reactive atmosphere, to a predetermined particle size thereby forming second particles of Zinc Soluble Metal-Based Metal values;

(f) dehydriding said second particles at a temperature between about 400° and 700° C. under conditions operative to remove essentially all hydrogen values from said second particles to produce dehydrided particles of Zinc Soluble Metal-Based Metal values; and (g) contacting said dehydrided particles with a small amount of a gas selected from the group consisting of oxygen, nitrogen, and mixtures thereof under conditions operative to passify said dehydrided particles thereby producing passified Zinc Soluble Metal-Based Metal particles which are substantially free of halides, zinc, hydrogen, nitrogen, oxygen and carbon; and (h) said forming of particles in step (a), said heating of said first particles in step (c), and said comminuting of said embrittled Metal values to predetermined particle size distribution in step (e) being operative to cause said passified Zinc Soluble Metal-Based Metal particles produced in step (g) to have a particle size distribution such that at least a substantial amount by weight of said particles are suitable for powder metallurgy usage with further particle size reduction.

47. A power metal consisting of a zinc soluble base metal selected from the group consisting of Ti, Mn, Fe, Co, Ni, Cu, Ge, Y, Zr, Rh, Pd, Ag, Sb, Hf, Pt, Au, Pr, U and mixtures thereof having an average particle size of about 100 mesh and having less than about 50 PPM of halide and an internal porosity of more than 20% by volume, said powder comprising angular shaped particles.

48. Passified Zinc Soluble Metal-Based Metal particles which are substantially free of halides, zinc, hydrogen, oxygen, nitrogen and carbon and which are suitable for powder metallurgy usage prepared from zinc soluble metal-based metal alloy comprising:

(a) forming particles of a Zinc Soluble Metal-Based Metal-zinc alloy, substantially free of halides, hydrogen, oxygen, nitrogen and carbon, into particles having an average particle size of about 100 mesh;

(b) heating said particles in a zone maintained at a temperature between about 900° and about 950° C., and simultaneously introducing into said zone a continuous flow of a nondeleteriously reactive sweep gas, said zone being maintained under conditions operative to vaporize and separate zinc from said particles and to produce particles of Zinc Soluble Metal-Based Metal which are substantially free of zinc and have an internal porosity of more than about 20% by volume;

(c) heating said Zinc Soluble Metal-Based Metal particles at a sintering temperature between about 1020° and 1060° C. under conditions operative to sinter said particles;

(d) contacting said sintered particles at a temperature between about ambient temperature and about 60 C. with a small amount of a gas selected from the group consisting of oxygen, nitrogen and mixtures thereof under conditions operative to passify said cooled sintered particles thereby producing Zinc Soluble Metal-Based Metal particles which are substantially free of halides, zinc, hydrogen, oxygen, nitrogen and carbon; and (e) said forming of said Zinc Soluble Metal-Based Metal-zinc alloy particles in step (a) and said heating of said Zinc Soluble Metal-Based Metal particles in step (c) being operative to cause said passified Zinc Soluble Metal-Based Metal particles produced in step (d) to have a particle size distribution such that a significant amount by weight of said passified Zinc Soluble Metal-Based Metal particles are suitable for powder metallurgy usage without additional particle size reduction.

49. A process to produce passified Zinc Soluble Metal-Based Metal particles which are substantially free of halides, zinc, hydrogen, oxygen and carbon and suitable for powder metallurgy usage, from a Zinc Soluble Metal-Based Metal-zinc alloy comprising:

(a) forming a Zinc Soluble Metal-Based Metal-zinc alloy, which is substantially free of halides, hydrogen, oxygen and carbon, into irregular shaped particles having an average particle size of about 100 mesh;

(b) heating said Zinc Soluble Metal-Based Metal-zinc alloy particles in a zone maintained at a temperature between about 900° and about 950° C. under conditions operative to vaporize and separate zinc from said particles and to produce particle of Zinc Soluble Metal-Based Metal which sare substantially free of zinc;

(c) contacting said Zinc Soluble Metal-Based Metal particles at a temperature between ambient temperature and about 60° C. with a small amount of a gas selected from the group consisting of oxygen, nitrogen and mixtures thereof under conditions operative to passify said particles thereby producing passified Zinc Soluble Metal-Based Metal particles; and (d) said forming of Zinc Soluble Metal-Based Metal-zinc alloy particles in step (a), and said heating of said particles in step (b) being operative to cause said passified Zinc Soluble Metal-Based Metal particles produced in step (c) to have a particle size distribution such that at least a substantial amount by weight of said Zinc Soluble Metal-Based Metal particles are suitable for powder metallurgy usage without further particle size reduction.

50. A metal sponge consisting of a Zinc Soluble Metal-Based Metal useful for metallurgical application characterized as having less than 10 PPM by weight halide, less than about 2500 PPM by weight oxygen, less than about 400 PPM by weight nitrogen, and less than about 800 PPM by weight carbon, and an internal porosity of about 10% to about 20% by volume, said Zinc Soluble Metal-Based Metal being selected from the group consisting of Mn, Fe, Co, Ni, Cu, Ge, Y, Rh, Pd, Ag, Sb, Pt, Au, Pr, U and mixtures thereof.

51. A metal alloy sponge consisting of titanium and nickel useful for metallurgical applications characterized as having less than 10 PPM by weight halide, less than about 2500 PPM by weight oxygen, less than about 400 PPM by weight nitrogen, less than about 800 PPM by weight carbon, and an internal porosity of about 10 to about 20% by volume.

52. A process to produce passified Zinc Soluble Metal-Based Metal particles which are substantially free of halides, and which are suitable for powder metallurgy usage, from a Zinc Soluble Metal-Based Metal-Zinc alloy comprising:

(a) forming a Zinc Soluble Metal-Based Metal-zinc alloy, which is substantially free of halides, into particles having an average particle size of about 100 mesh;

(b) heating said particles in a zone maintained at a temperature between about 900° and 950° C. and simultaneously introducing into said zone a continuous flow of a nondeleteriously-reactive sweep gas, said zone being maintained under conditions operative to vaporize and separate zinc from said particles and to produce particles of Zinc Soluble Metal-Based Metal which are substantially free of zinc and halides;

(c) sintering said first particles at a sintering temperature between about 1020° and 1060° C. under conditions operative to sinter said particles;

(d) contacting said sintered particles with a small amount of a gas selected from the group consisting of oxygen, hydrogen and mixtures thereof at a temperature between ambient temperature and about 60° C. under conditions operative to passify said sintered particles, thereby producing passified Zinc Soluble Metal-Based Metal particles which are substantially free of halides and zinc; and (e) said forming of Zinc Soluble Metal-Based Metal-zinc alloy particles in step (a), and said heating of said particles in step (b) being operative to cause said passified particles produced in step (d) to have particle size distribution such that a significant amount of weight of said passified Zinc Soluble Metal-Based Metal particles are suitable for powder metallurgy usage without additional particle size reduction.

* * * * *